US007992239B2

(12) United States Patent
Hornbach et al.

(10) Patent No.: US 7,992,239 B2
(45) Date of Patent: Aug. 9, 2011

(54) LATERALLY ROTATING PATIENT SUPPORT APPARATUS

(75) Inventors: David W. Hornbach, Brookville, IN (US); Darrell L. Metz, Batesville, IN (US); Jonathan D. Turner, Dillsboro, IN (US); Terry J. Stratman, Villa Hills, KY (US)

(73) Assignee: Hill-Rom Services, Inc., Batesville, IN (US)

( * ) Notice: Subject to any disclaimer, the term of this patent is extended or adjusted under 35 U.S.C. 154(b) by 148 days.

(21) Appl. No.: 12/194,937

(22) Filed: Aug. 20, 2008

(65) Prior Publication Data

US 2009/0049612 A1 Feb. 26, 2009

Related U.S. Application Data

(60) Provisional application No. 60/956,902, filed on Aug. 20, 2007.

(51) Int. Cl.
*A61G 7/008* (2006.01)
*A61G 7/015* (2006.01)

(52) U.S. Cl. ..... 5/607; 5/616; 5/600

(58) Field of Classification Search ..... 5/607–610, 5/600, 616, 108, 109, 86.1, 81.1 R
See application file for complete search history.

(56) References Cited

U.S. PATENT DOCUMENTS

| | | | | |
|---|---|---|---|---|
| 524,969 | A * | 8/1894 | Lottridge | 297/135 |
| 1,166,018 | A * | 12/1915 | Soresi | 5/608 |
| 1,266,268 | A | 5/1918 | Hollowell | |
| 3,206,188 | A * | 9/1965 | Douglass, Jr. | 5/614 |
| 3,806,109 | A | 4/1974 | Weber et al. | |
| 3,900,906 | A | 8/1975 | Berthelsen | |
| 4,451,945 | A | 6/1984 | Heinz et al. | |
| 4,474,364 | A | 10/1984 | Brendgord | |
| 4,654,903 | A | 4/1987 | Chubb et al. | |
| 4,731,889 | A * | 3/1988 | Ishikawa | 5/607 |
| 4,927,127 | A | 5/1990 | Lock | |
| 5,023,967 | A | 6/1991 | Ferrand | |
| 5,181,288 | A | 1/1993 | Heaton et al. | |
| 5,228,155 | A * | 7/1993 | Shultz et al. | 5/109 |
| 5,299,334 | A | 4/1994 | Gonzalez | |
| 5,410,768 | A | 5/1995 | Manson et al. | |
| 6,269,499 | B1 | 8/2001 | Amir | |
| 6,427,263 | B1 | 8/2002 | Lindell | |

(Continued)

FOREIGN PATENT DOCUMENTS

EP 0474694 B1 10/1994

(Continued)

*Primary Examiner* — Robert G Santos

(74) *Attorney, Agent, or Firm* — Jason Penninger

(57) ABSTRACT

A patient support apparatus comprises a lower frame, a lift mechanism, a drive mechanism, and an upper frame. The lower frame includes a lift drive configured to at least one of expand and contract the lift mechanism. The lift mechanism is pivotably coupled with the lower frame to rotate about a rotational axis. A drive mechanism is coupled between the lift mechanism and the lower frame. The drive mechanism is configured to rotate the lift mechanism about the rotational axis. The upper frame is supported on the lift mechanism and responsive to the rotation of the lift mechanism to rotate a patient about the rotational axis.

20 Claims, 12 Drawing Sheets

U.S. PATENT DOCUMENTS

| | | | | |
|---|---|---|---|---|
| 6,779,210 | B1 * | 8/2004 | Kelly | 5/611 |
| 6,817,363 | B2 | 11/2004 | Biondo et al. | |
| 6,851,144 | B2 * | 2/2005 | Wang | 5/610 |
| 6,862,759 | B2 | 3/2005 | Hand et al. | |
| 6,874,181 | B1 | 4/2005 | Connolly et al. | |
| 2005/0120480 | A1 | 6/2005 | Benedict et al. | |
| 2009/0049612 | A1 * | 2/2009 | Hornbach et al. | 5/607 |

FOREIGN PATENT DOCUMENTS

| | | | |
|---|---|---|---|
| EP | 0705091 | B1 | 5/1997 |
| EP | 0743054 | B1 | 7/2002 |
| EP | 1419756 | B1 | 9/2007 |
| WO | 9811858 | A1 | 3/1998 |
| WO | 2006123333 | A2 | 11/2006 |
| WO | 2007145544 | A1 | 12/2007 |

* cited by examiner

LATERALLY ROTATING PATIENT SUPPORT APPARATUS

This disclosure claims priority to U.S. Provisional Application Ser. No. 60/956,902, filed on Aug. 20, 2007.

BACKGROUND

This disclosure relates to laterally rotating patient support apparatuses, and more particularly, but not exclusively to laterally rotating patient support apparatuses with a pivot mechanism that laterally rotates a support pivotably coupled with a lower frame at a pivot and an upper frame coupled with the support about a rotational axis defined by the pivot.

It is often necessary for caregivers to transfer patients from one support apparatus to another. In order to transfer the patients, caregivers may be required to physically pull or lift a portion of the patient or a material under the patient. Often times only a single caregiver transfers the patient, which requires the caregiver to exert the total amount of force needed to transfer the patient and increases the risk of injury. Over time the strain of transferring patients manually can lead to caregivers suffering back injuries. One solution has been to laterally rotate the upper frame of a patient support apparatus so that the patient slides down the inclined surface to a second support apparatus. While various laterally rotating apparatuses have been developed, in certain applications there is still room for improvement. Thus, a need persists for further contributions in this area of technology.

SUMMARY OF THE DISCLOSURE

One embodiment may include a lower frame with a pivot mechanism that laterally rotates a support pivotably coupled with a lower frame at a pivot and an upper frame coupled with the support about a rotational axis defined by the pivot. In other embodiments, a synchronization system is utilized to synchronize the rotation of a support pivotably coupled with a lower frame at a pivot and coupled with an upper frame about a rotational axis defined by the pivot.

Additional features, which alone or in combination with any other feature(s), such as those listed above and/or those listed in the claims, may comprise patentable subject matter and will become apparent to those skilled in the art upon consideration of the following detailed description of various embodiments exemplifying the best mode of carrying out the embodiments as presently perceived.

DESCRIPTION OF SPECIFIC EMBODIMENTS

Figure 1:
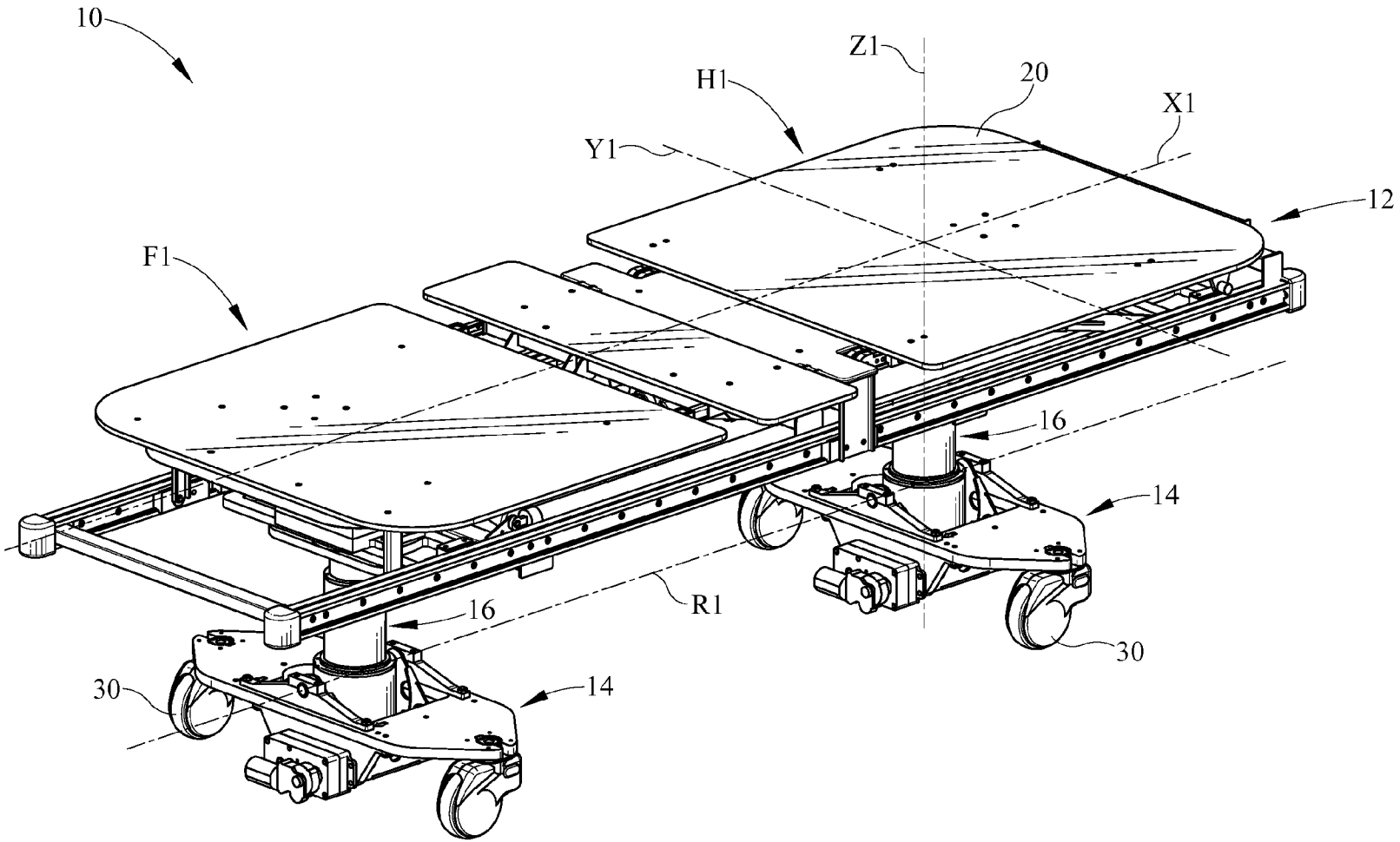
FIG. 1 is a perspective view of patient support apparatus according to one embodiment of the current disclosure.
Figure 2:
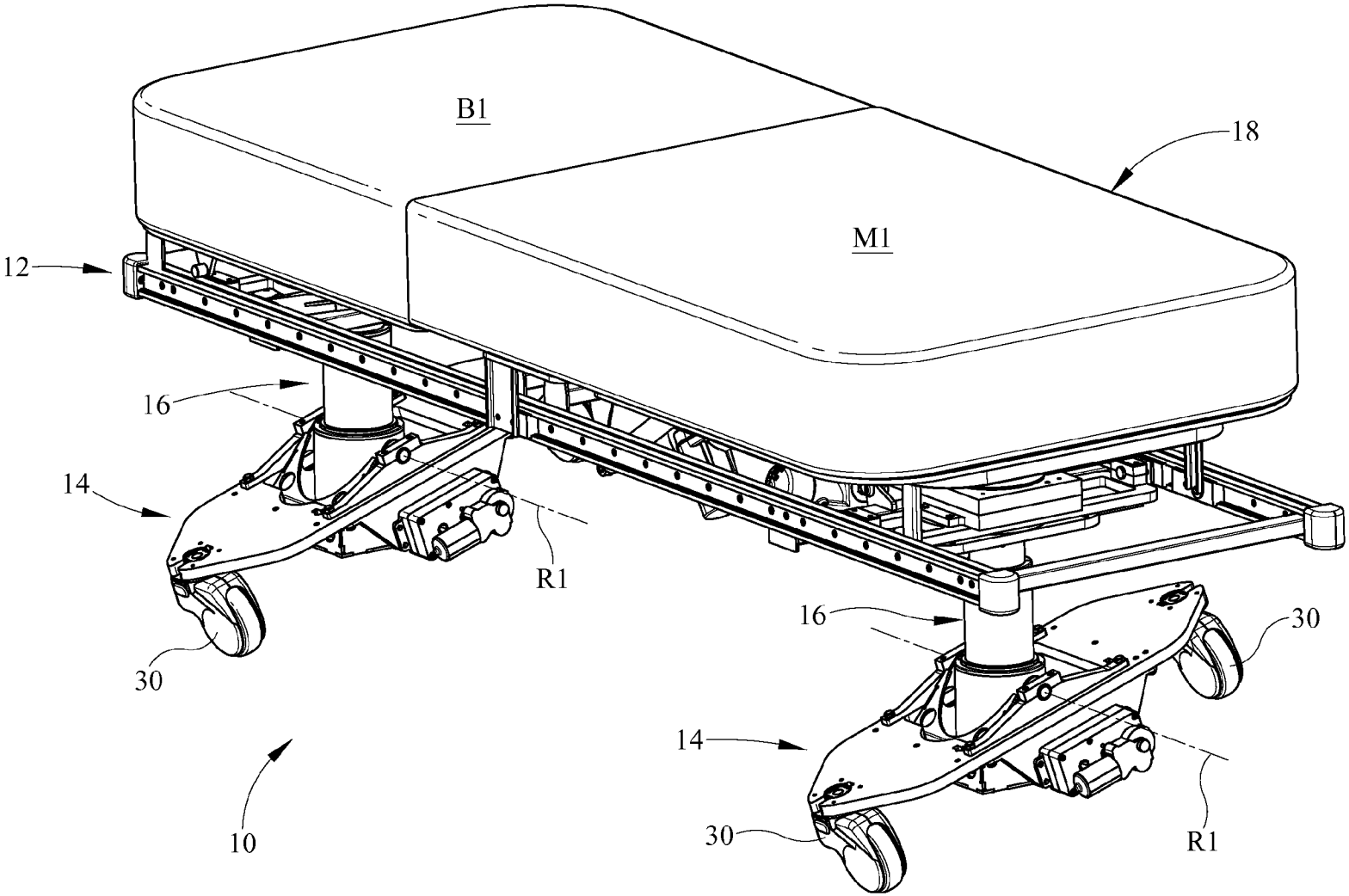
FIG. 2 is a perspective view of patient support apparatus of FIG. 1.

While the present disclosure can take many different forms, for the purpose of promoting an understanding of the principles of the disclosure, reference will now be made to the embodiments illustrated in the drawings, and specific language will be used to describe the same. No limitation of the scope of the disclosure is thereby intended. Various alterations, further modifications of the described embodiments, and any further applications of the principles of the disclosure, as described herein, are contemplated.

A patient support apparatus 10 according to one illustrative embodiment of the current disclosure is shown in FIGS. 1-5 and 9. The patient support apparatus 10 may include a head section H1, where the head of a patient (not shown) is positioned, and a foot section F1, where the feet of a patient (not shown) are positioned. The patient support apparatus 10 may include an upper frame assembly 12, a lower frame assembly 14 or base 14, and a plurality of supports 16 coupled with the upper frame assembly 12 and pivotably coupled with the lower frame assembly 14. It should be appreciated that the patient support apparatus 10 may include only one support 16. The upper frame assembly 12 and the supports 16 may laterally rotate about the lower frame assembly 14 to assist with the transfer of a patient from the patient support apparatus 10 to an adjacent support apparatus/surface (not shown). It should be appreciated that the supports 16 may laterally rotate and raise/lower the upper frame assembly 12 simultaneously, which may configured the patient support apparatus 10 to operate as a chair and/or assist with patient egress.

Figure 8:
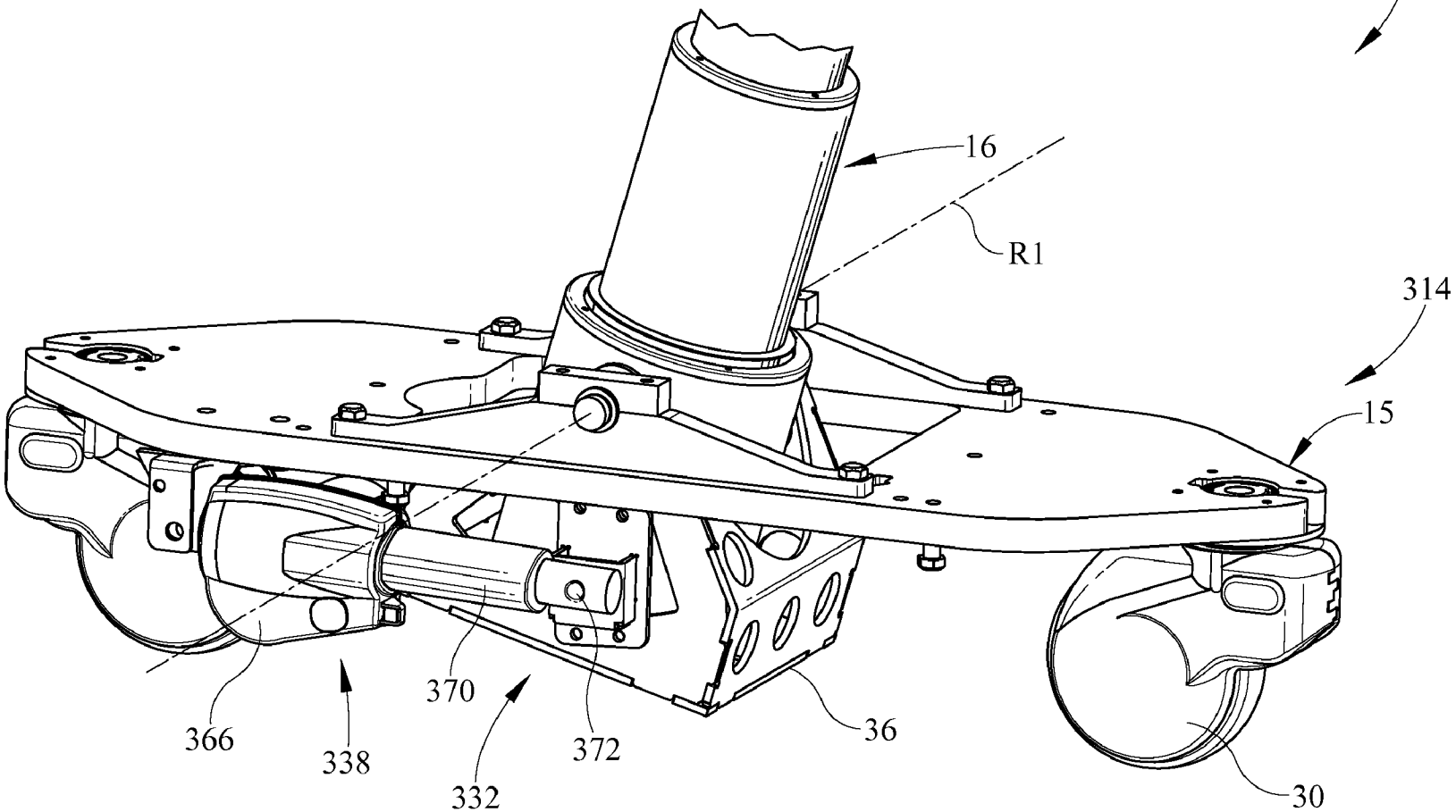
FIG. 8 is a perspective end view of the drive mechanism according to still another embodiment of the current disclosure.

The patient support apparatus 10 may support a patient support surface 18 on the upper frame assembly 12. The patient support surface 18 may be configured to support a patient (not shown) in multiple articulated positions. The patient support surface 18 may be formed of multiple sections that may include a back portion B1 and a main portion M1. It should be appreciated that the patient support surface 18 may be formed of a single section. The back portion B1 may be pivoted relative the upper frame portion 14 and the main portion M1 to raise and lower the head of the patient supported thereon as shown in FIG. 8.

The upper frame assembly 12 may include a deck 20 having multiple sections that may articulate about a lateral axis Y1 or transverse axis Y1 as shown in FIG. 1. It should be appreciated that the upper frame assembly 12 may only include a single section that may articulate about the lateral axis Y1 or an axis parallel thereto. It should also be appreciated that the upper frame assembly 12 may not articulate. It should further be appreciated that the upper frame assembly 12 may be the deck 20. The upper frame assembly 12 defines a longitudinal axis X1 that extends at least the length of the patient support apparatus 10 through the head end H1 and the foot end F1 along the lateral center of the upper frame assembly 12.

The supports 16 define a vertical axis Z1 when positioned perpendicular the lower frame assembly 14 such that the upper frame assembly 12 is substantially parallel the lower frame assembly 14. The supports 16 may be lift mechanisms 16 with a lift driver (not shown) that may cause the lift mechanisms 16 to expand and/or contract to raise and/or lower the upper frame assembly 12 with respect to the lower frame assembly 14. It should be appreciated that the supports 16 may be rotational lifts, hydraulic lifts or actuators, pneumatic lifts or actuators, linear actuators, chain lifts, or other lift mechanisms. The supports 16 include an upper support portion 22 coupled with the upper frame assembly 12 and a lower support portion 24 pivotably coupled with the lower frame assembly 14.

The lower support portions 24 may include pivot rods 26 and protrusions 28 or follower pins 28 coupled thereto. It should be appreciated that the lower support portions 16 may not include pivot rods 26 and instead may include a bore (not shown) therein for receiving pivot rods 26. It should also be appreciated that the pivot rods 26 and/or the follower pins 28 may be formed with the lower support portions 24. The pivot rods 26 rotatably engage the lower frame assembly 14 and define a rotational axis R1 about which the supports 16 and upper frame assembly 12 rotate. The follower pins 28 are movable within rotational limit guides 40 of the lower frame assembly 14. The follower pins 28 cooperate with limit detectors 42 to limit the magnitude of the rotation of the supports 16 and the upper frame assembly 12 to about 20° with respect to the vertical axis V1. It should be appreciated that the magnitude of the rotation may be rotated greater than 20°, but the risk of tipping the patient support apparatus 10 over increases as the magnitude of the rotation increases.

Figure 3:
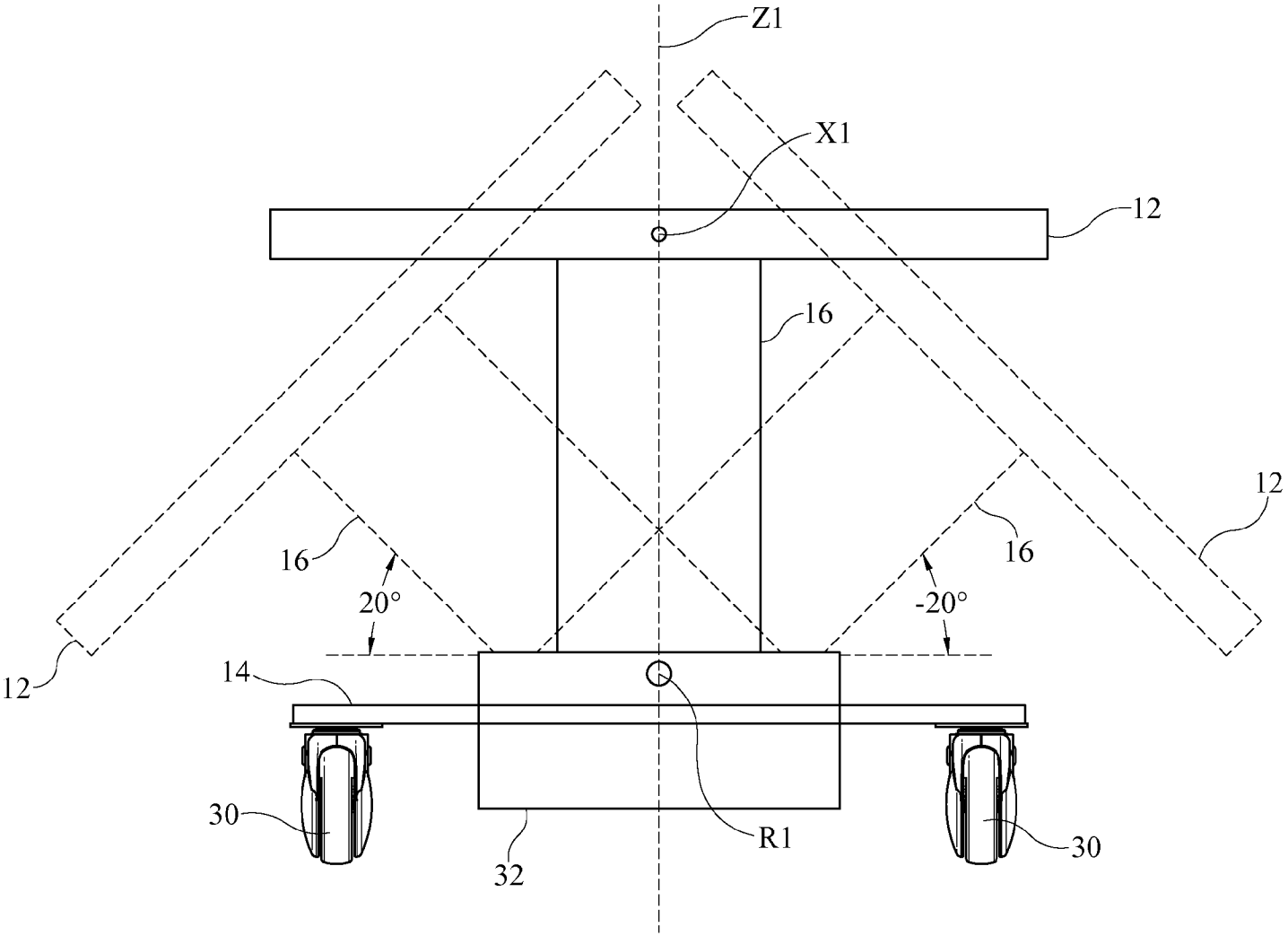
FIG. 3 is a partial diagrammatic end view of the patient support apparatus of FIG. 1.
Figure 10:
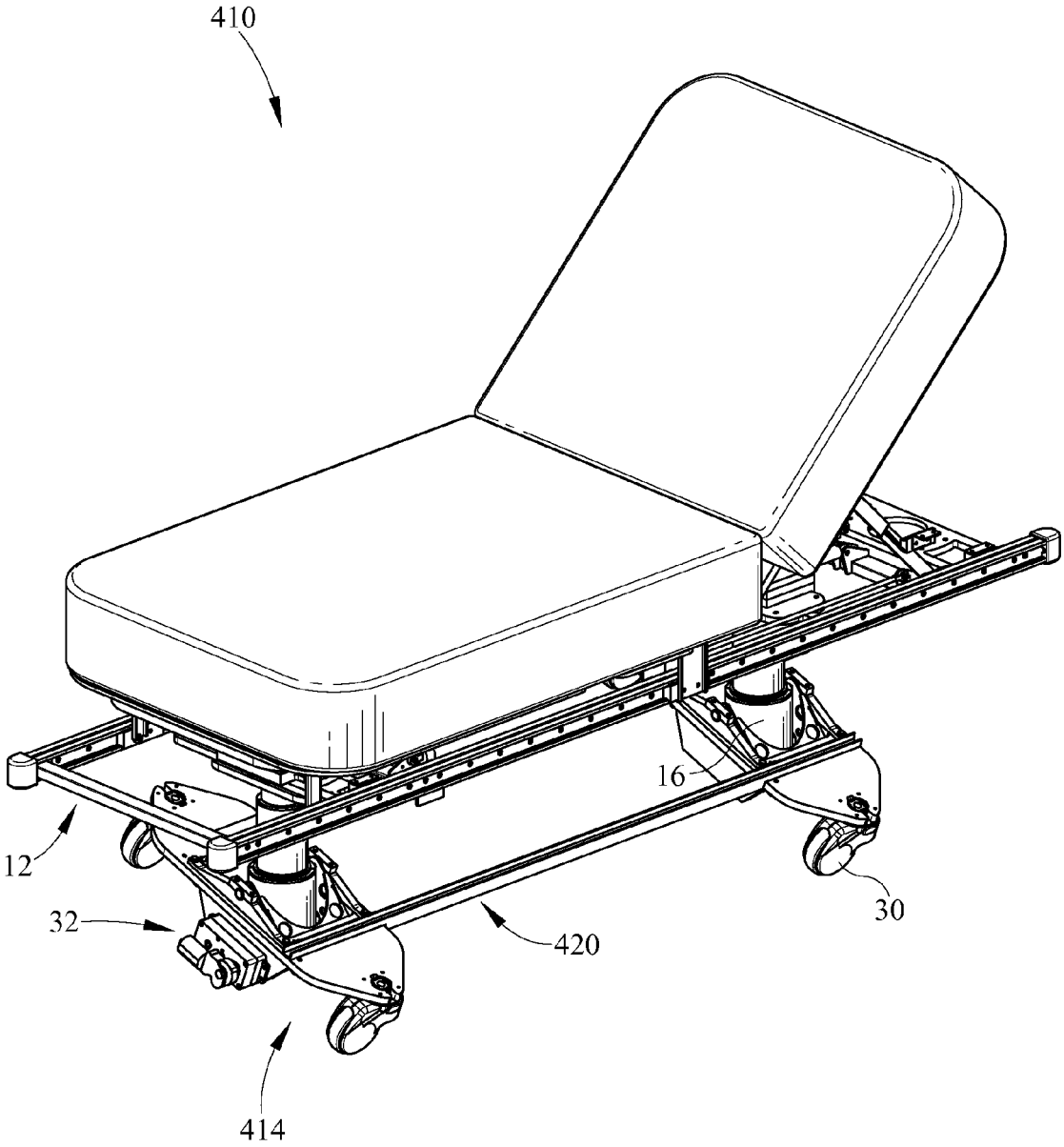
FIG. 10 is a perspective side view of patient support apparatus according to another embodiment of the current disclosure including a synchronizing system.

The lower frame assembly 14 may include multiple sections as shown in FIG. 1 and may be supported by a plurality of casters 30. It should be appreciated that the lower frame assembly 14 may include a single section or may include multiple sections that are connected together as shown in FIG. 10. The lower frame assembly 14 includes a lower frame portion 15 and a pivot mechanism 32 as shown in FIG. 3. It should be appreciated that the pivot mechanism 32 may be separate from the lower frame portion 15 and may be coupled with the lower frame portion 15. The pivot mechanism 32 may be coupled with the lower frame portion 15 about the lateral center of the lower frame portion 15. The pivot mechanism 32 includes a pivot 34, a carriage 36, a drive mechanism 38, a limit detector 40, and a rotational limit guides 42. It should be appreciated that the pivot mechanism 32 may not include a carriage 36 and the support 16 may be pivotably coupled about the pivot 34. It should be appreciated that the pivot mechanism 32 may include a ball and socket assembly (not shown).

Figure 4:
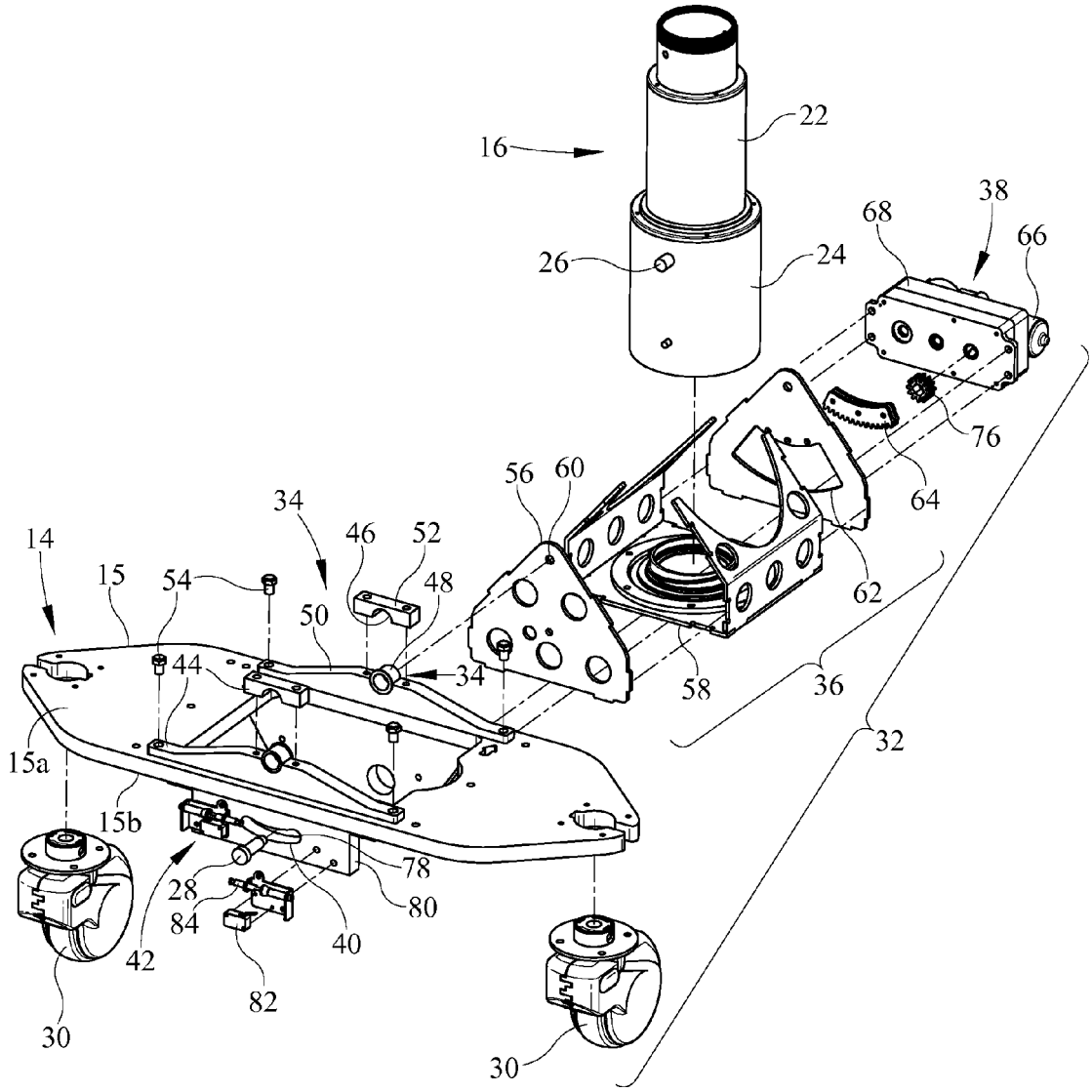
FIG. 4 is an exploded perspective view of the support and the lower frame of FIG. 1.

The pivot 34, as shown in FIG. 4, may include pivot members 44, pivot bores 46 extending at least partially through the pivot members 44, and pivot bearings 48. The pivot members 44 may include a lower pivot member 50 and an upper pivot member 52 coupled with the lower pivot member 50. The lower pivot members 44 are coupled substantially perpendicularly with the upward facing surface 15*a* of the lower frame portion 15 by fasteners 54 and/or an adhesive (not shown). It should be appreciated that the lower pivot member 44 may be integrally formed with the lower frame portion 15. It should also be appreciated that the lower pivot member 44 may be angularly coupled with the upward facing surface 15*a* of the lower frame portion 15. It should further be appreciated that the pivot 34 may not include a pivot bearing 48 and the pivot members 44 may be at least partially composed of a bearing quality material, such as, nylon or similar low resistance materials.

The pivot bores 46 extend at least partially through the pivot members 44. The pivot bores 46 cooperate to define a rotational axis R1 that may be parallel the longitudinal axis X1. The pivot bores 46 retain the pivot bearings 48 therewithin. It should be appreciated that the pivot bores 46 may not retain the pivot bearings 48 therein. The pivot bearings 48 may be adapted to rotatably support the pivot rods 26 of the supports 16 and/or the carriages 36. It should be appreciated that at least a portion of the pivot bores 46 may be lubricated with oil, grease, graphite, or other low-friction lubricants.

The carriage 36, as shown in FIG. 4, is pivotably coupled with the pivot 34 and rotates with respect to the lower frame portion 15 about the rotational axis R1. The carriage 36 includes carriage side members 56 coupled with a carriage bottom 58, a carriage bore 60, a drive opening 62, and a carriage gear 64. It should also be appreciated that the carriages 36 may not include the drive opening 62 and may instead be coupled with the drive mechanism 38. The carriage bottom 58 may be adapted to support the support 16. It should be appreciated that the carriage bottom 58 may couple with the support 16. The carriage bore 60 may extend through the carriage side members 56 and rotatably engage the pivot rod 26 to rotate about the rotational axis R1. The drive opening 62 may be formed in at least one of the carriage side members 56 and at least a portion of the drive mechanism 38 may move therewithin. The carriage gear 64 may be coupled with the carriage 36 proximate the drive opening 62. It should be appreciated that the carriage gear 64 may be formed in the drive opening 62. It should also be appreciated that the carriage gear 64 may be coupled with or formed in the supports 16.

Figure 5:
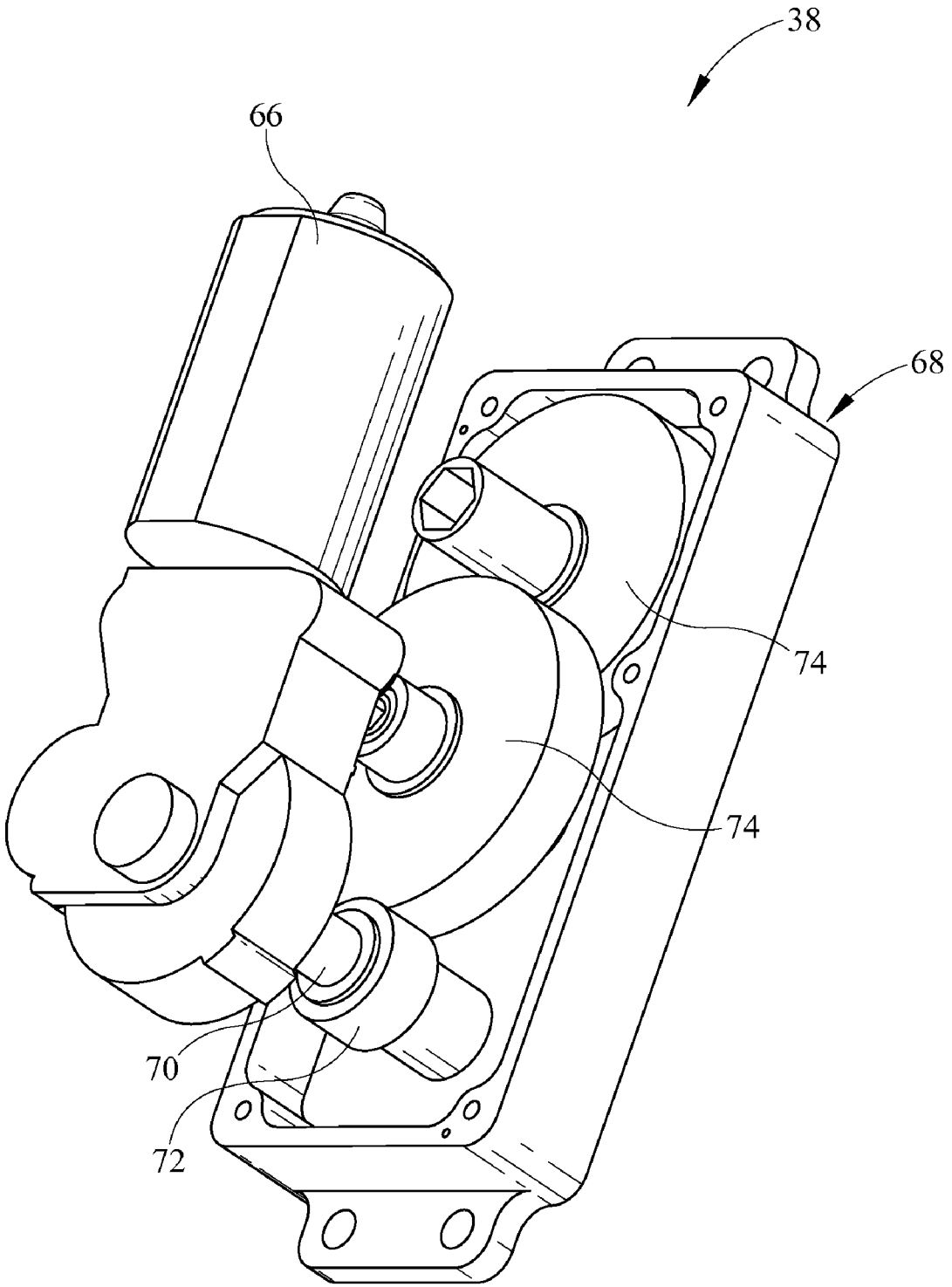
FIG. 5 is a perspective side view of the drive mechanism of FIG. 1 including a motor and a gearbox.
Figure 6:
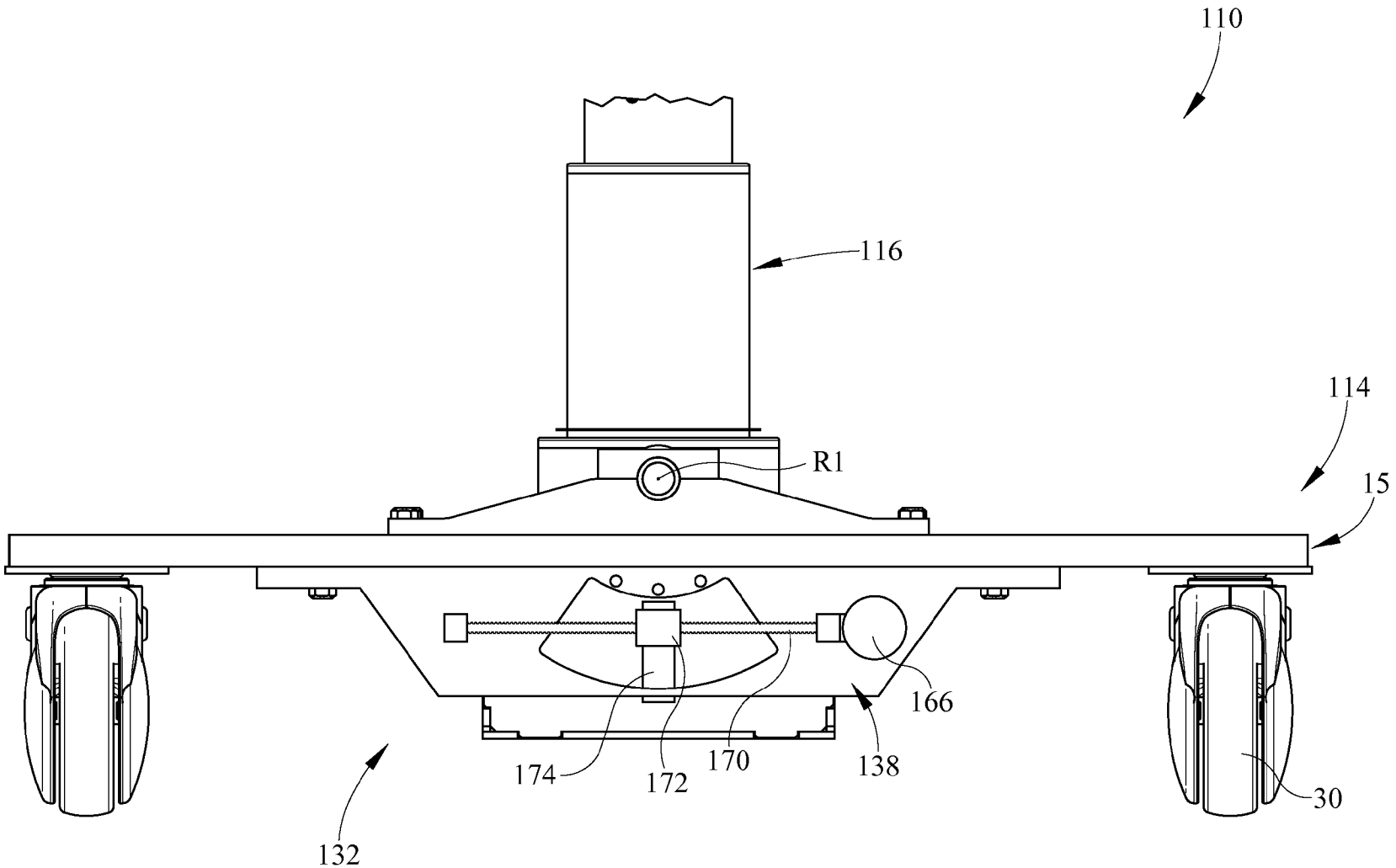
FIG. 6 is an end side view of the drive mechanism according to another embodiment of the current disclosure.
Figure 7:
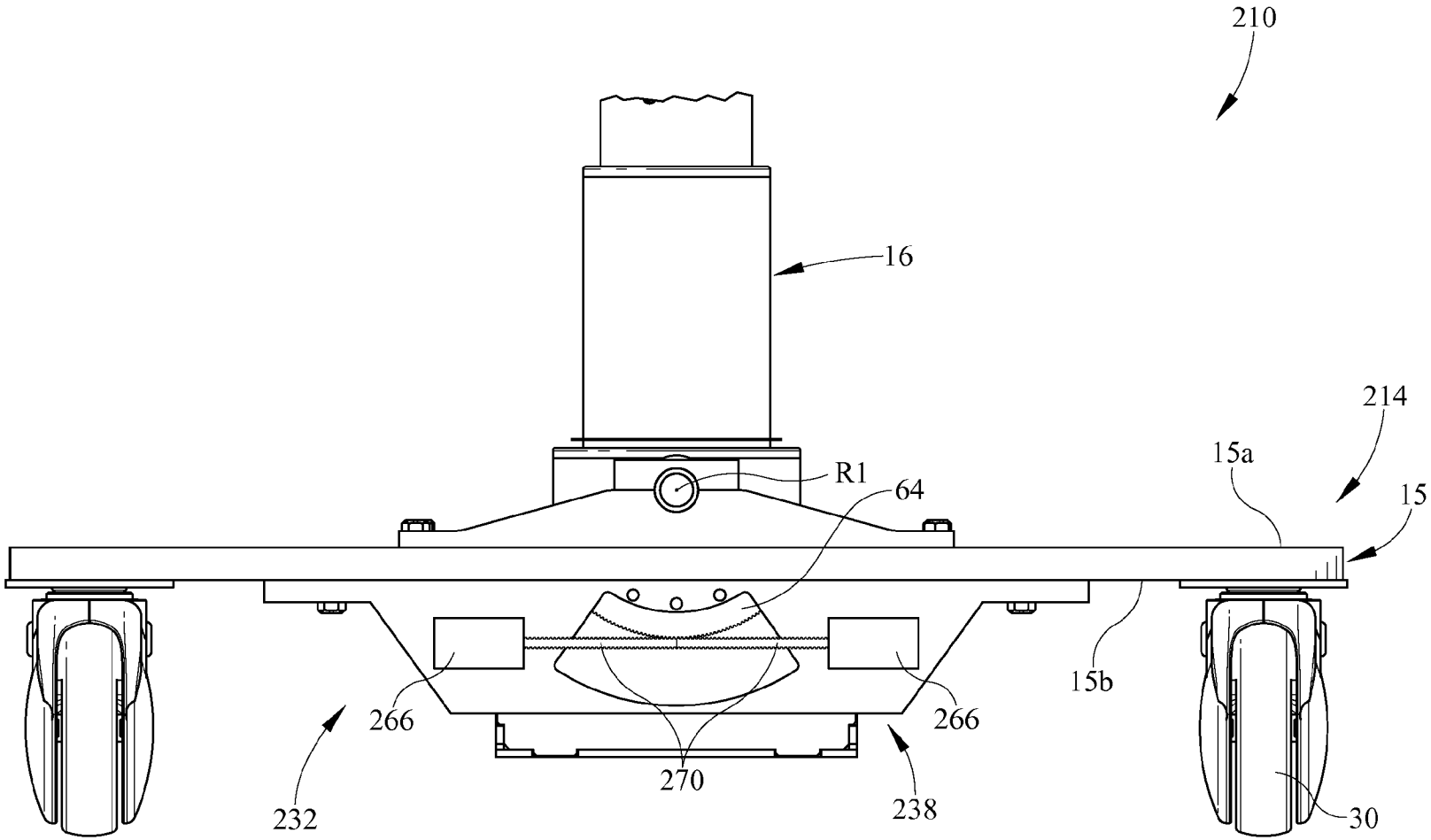
FIG. 7 is an end side view of the drive mechanism according to yet another embodiment of the current disclosure.

The drive mechanism 38 or drive 38, as shown in FIGS. 4- and 5, may be coupled with the lower frame portion 15 and may engage the carriage 36 below the pivot 34. It should be appreciated that the drive mechanism 38 may be coupled with the support 16 or the upper frame assembly 12 and pivotably coupled with the carriage 36, or may be coupled with the support 16, the lower frame portion 15, or the upper frame and pivotably coupled with the support 16. It should also be appreciated that the drive mechanism 38 may engage the support 16 below the pivot 34 and/or may engage the carriage 36 or the support 16 above the pivot 34. It should further be appreciated that the drive mechanism 38 may engage the pivot 34. The drive mechanism 38 includes a motor 66 and a gear box 68 as shown in FIGS. 4 and 5. It should be appreciated that the drive mechanism 38 may include a motor 166 with a threaded shaft 170 that rotatably engages a nut 172 as shown in FIG. 6 and described below. It should also be appreciated that the drive mechanism 38 may include a motor 266 with a worm gear 270 as shown in FIG. 7 and described below. It should further be appreciated that the drive mechanism 38 may include a linear actuator 366 as shown in FIG. 8 and described below. It should still further be appreciated that the drive mechanism 38 may include a manual crank (not shown), a lever arrangement (not shown), a pedal arrangement (not shown), a locking pin arrangement (not shown), or a multi-position locking mechanism (not shown). The motor 66 may be an electric motor and may include a motor shaft 70 and a motor gear 72 coupled with the motor shaft 70.

The gear box 68, shown in FIG. 5, may include a plurality of drive gear assemblies 74 rotatably coupled within the gear box 68 that may be engaged by the motor gear 72. It should be appreciated that the motor gear 72 may only engage one of the drive gear assemblies 74 directly and that the other drive gear assemblies 74 may be rotated by the engaged drive gear assembly 74. One of the drive gear assemblies 68 may be an output drive assembly 76 that rotatably engages the carriage gear 64 of the carriage 36 to rotate the carriage 36 about the pivot 34, as shown in FIG. 4. It should be appreciated that the output gear 76 may rotatably engage a portion of the support 16 or the lower frame portion 15 to rotate the support 16 about the pivot 34.

Figure 9:
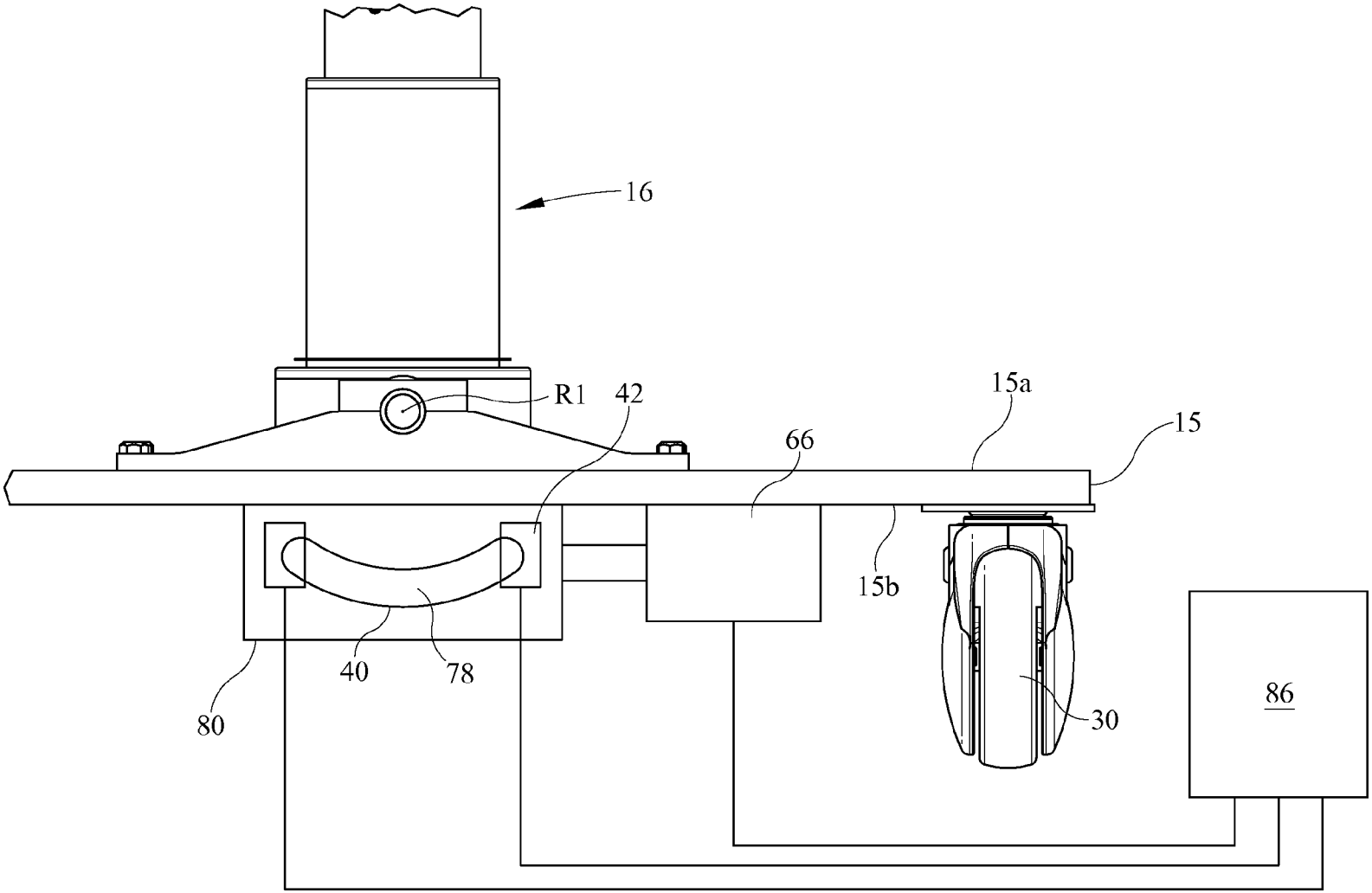
FIG. 9 is a partial diagrammatic end view of the lower frame according FIG. 1 including a controller and limit detectors positioned proximate a rotational limit guide.

The rotational limit guide 40, shown in FIGS. 4 and 9, may include a slot 78 formed in a downward extending portion 80 of the lower frame portion 15 that extends from the downward facing surface 15*b* of the lower frame portion 15*b*. The slot 78 may be arcuately shaped along an arc defined by the rotation of the follower pins 28 about the rotational axis R1. It should be appreciated that the slot 78 may be linear or other shapes. The slot 78 may be about the diameter of the follower pins 28.

The limit detectors 42, shown in FIGS. 4 and 9, may be coupled with the downward extending portion 80 proximate the rotational limit guide 40. It should be appreciated that the patient support apparatus 10 may not include limit detectors 42 and may only include the rotational limit guide 40 to limit the movement of the follower pins 28 therewithin, thereby limiting the pivoting of the supports 16 and the upper frame assembly 12. Each limit detector 42 includes a plurality of limit switches 82 that are activated by plungers 84. The plungers 84 may have an irregular shape such that movement of a plunger 84 over one or more of the limit switches 82 activates or deactivates the limit switches 82 to generate a rotational signal corresponding to the position of the supports 16. The rotational signals are read by a controller 86, shown in FIG. 9, to determine the rotational magnitude and/or position of the supports 16 and/or upper frame assembly 12 about rotational axis R1.

Describing now the operation of these various illustrative embodiments, the motors 66 are activated and rotate the motor shafts 70. The rotation of the motor shafts 70 causes the motor gears 72 to rotate, which causes the drive gear assemblies 74, including the output gears 76, to rotate. The rotation of the output gears 76 causes the carriage gears 64 to rotate the carriages 36 about the pivots 34. As the carriages 36 rotate, the supports 16 and the upper frame assembly 12 are rotated about the rotational axis R1. As the supports 16 and the upper frame assembly 12 rotate, the follower pins 28 move within the slots 78 of the rotational limit guides 40 and engage the plungers 84 of the limit detectors 42. The limit detectors 42 generate a rotational signal in response to the distance the plungers 84 are displaced across the limit switches 82. The supports 16 and the upper frame assembly 12 are rotated until the motor 66 is stopped by a signal sent from the controller 86 indicating that the rotational magnitude of the supports 16 and the upper frame assembly 12 has reached a predetermined threshold of approximately 20°.

A patient support apparatus 110 according to another embodiment of the current disclosure is shown in FIG. 6, wherein like numerals refer to like features previously described. The patient support apparatus 110 includes an upper frame assembly 12, a lower frame assembly 114, and a support 116. The lower frame assembly 114 includes a lower frame portion 15 and a pivot mechanism 132. The pivot mechanism 132 includes a pivot 34, a carriage 36, a drive mechanism 138, limit detectors 40, and rotational limit guides 42. The drive mechanism 138 may include a motor 166 with a threaded shaft 170 and a nut 172 that rotatably engages the threaded shaft 170. The threaded shaft 170 may be, for example, an acme screw 170 that extends from the motor 166 positioned on one side of the carriage 36 or the support 116 and coupled with the lower frame portion 15 on the other side of the carriage 36 or the support 116. The nut 172 may slidably engage a recessed channel 174 formed in the support 116. It should be appreciated that the channel 174 may be formed in the carriage 36. It should also be appreciated that the channel 174 may be a guide (not shown) that protrudes from the support 116 and the nut 172 may include an engagement portion (not shown) that engages and moves along the guide (not shown). It should further be appreciated that the nut 172 may be include a retaining element (not shown) that engages a retaining groove (not shown) in the channel 174 to retain the nut 172 within the groove and prevent the nut 172 from rotating. It should still further be appreciated that the nut 172 may include at least one protrusion (not shown) that engages the channel 174 and/or another protrusion that slidably engages a guide channel (not shown) positioned opposite the channel 174 such that the nut 170 is positioned therebetween to prevent side-loading of the nut 170.

Describing now the operation of these various illustrative embodiments, the motor 166 is activated and rotates the threaded shaft 170. The rotation of the threaded shaft 170 causes the nut 172 to move along the threaded shaft 170 and within the channel 174, which causes the supports 116 to rotate about the pivot 34. As the supports 16 and the upper frame assembly 12 rotate, the follower pins 28 move within the slots 78 of the rotational limit guides 40 and engage the plungers 84 of the limit detectors 42. The limit detectors 42 generate a rotational signal in response to the distance the plungers 84 are displaced across the limit switches 82. The supports 116 and the upper frame assembly 12 are rotated until the motor 66 is stopped by a signal sent from the controller 86 indicating that the rotational magnitude of the supports 116 and the upper frame assembly 12 has reached a predetermined threshold of approximately 20°.

A patient support apparatus 210 according to another embodiment of the current disclosure is shown in FIG. 7, wherein like numerals refer to like features previously described. The patient support apparatus 210 includes an upper frame assembly 12, a lower frame assembly 214, and supports 16. The lower frame assembly 214 includes a lower frame portion 15 and a pivot mechanism 232. The pivot mechanism 232 includes a pivot 34, a carriage 36, a drive mechanism 238, limit detectors 40, and rotational limit guides 42. The drive mechanism 238 may include a motor 266 with a worm gear 270. The worm gear 270 may extend from the motor 266 positioned on one side of the carriage 36 or the support 16 and couple with the lower frame portion 15 on the other side of the carriage 36 or the support 16. The worm gear 270 may rotatably engage a carriage gear 64 coupled with the carriage 36 to rotate the carriage 36 and the support 16 about the pivot 34. It should be appreciated that the worm gear 270 may rotatably engage a carriage gear 64 coupled with the support 16 to rotate the carriage 36 and the support 16 about the pivot 34.

Describing now the operation of these various illustrative embodiments, the motor 266 is activated and rotates the worm gear 270. The rotation of the worm gear 270 causes carriage gear 64 coupled with the carriage 36 to rotate the carriage 36 about the pivot 34. As the carriage 36 rotates, the support 16 and the upper frame assembly 12 are rotated about the pivot 34. As the supports 16 and the upper frame assembly 12 rotate, the follower pins 28 move within the slots 78 of the rotational limit guides 40 and engage the plungers 84 of the limit detectors 42. The limit detectors 42 generate a rotational signal in response to the distance the plungers 84 are displaced across the limit switches 82. The supports 16 and the upper frame assembly 12 are rotated until the motor 266 is stopped by a signal sent from the controller 86 indicating that the rotational magnitude of the supports 16 and the upper frame assembly 12 has reached a predetermined threshold of approximately 20°.

A patient support apparatus 310 according to another embodiment of the current disclosure is shown in FIG. 8, wherein like numerals refer to like features previously described. The patient support apparatus 310 includes an upper frame assembly 12, a lower frame assembly 314, and supports 16. The lower frame assembly 314 includes a lower frame portion 15 and pivot mechanism 332. The pivot mechanism 332 includes a pivot 34, a carriage 36, a drive mechanism 338, limit detectors 40, and rotational limit guides 42. The drive mechanism 338 may include a linear actuator 366 that is coupled with the lower frame portion 15. The linear actuator 366 may include an actuator shaft 370 that may be pivotably coupled with the support 16 at an actuator pivot 372. It should be appreciated that the actuator shaft 370 may be pivotably coupled with the carriage 36.

Describing now the operation of these various illustrative embodiments, the linear actuator 366 is activated and moves the actuator shaft 370. The movement of the actuator shaft 370 causes the carriage 36 to rotate about the pivot 34. As the carriage 36 pivots, the support 16 and the upper frame assembly 12 are rotated about the pivot 34. As the supports 16 and the upper frame assembly 12 are rotated, the follower pins 28 move within the slots 78 of the rotational limit guides 40 and engages the plungers 84 of the limit detectors 42. The limit detectors 42 generate a rotational signal in response to the distance the plungers 84 are displaced across the limit switches 82. The supports 16 and the upper frame assembly 12 are rotated until the motor 366 is stopped by a signal sent from the controller 86 indicating that the rotational magnitude of the supports 16 and the upper frame assembly 12 has reached a predetermined threshold of approximately 20°.

Figure 11:
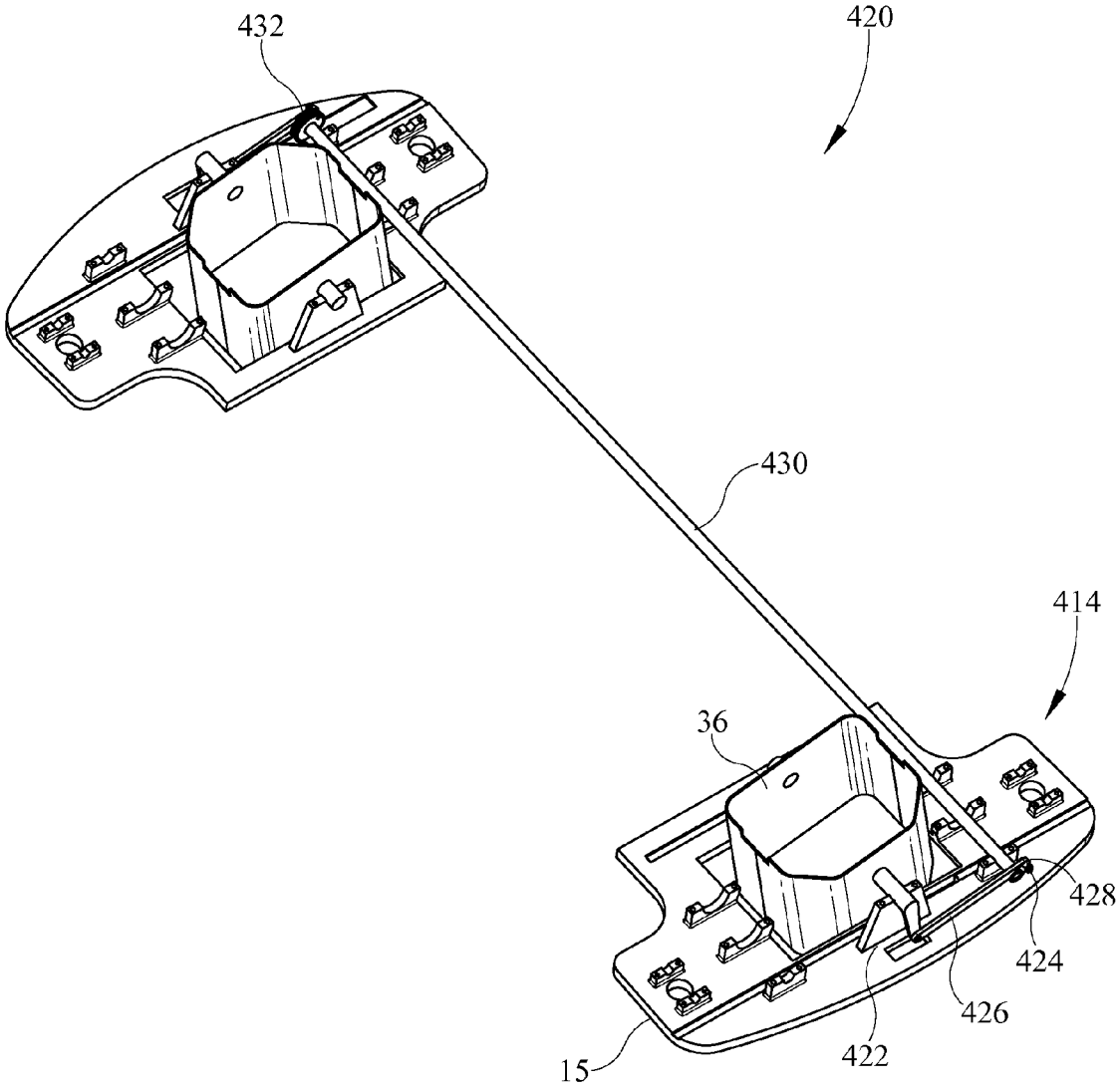
FIG. 11 is a perspective top view of the synchronizing system of FIG. 10.

A patient support apparatus 410 according to another embodiment of the current disclosure is shown in FIGS. 10 and 11, wherein like numerals refer to like features previously described. The patient support apparatus 410 includes an upper frame assembly 12, lower frame assembly 414, and supports 16. The lower frame assembly 414 includes a pivot mechanism 32 and a synchronizing system 420. The synchronizing system 420 may be coupled with the carriages 36 to synchronize the rotation of the supports 16 so that the supports 16 rotate about the rotational axis R1 simultaneously. It should be appreciated that the synchronizing system 420 may couple with the supports 16 to synchronize the rotation of the supports 16 so that the supports 16 rotate about the rotational axis R1 simultaneously.

The synchronizing system 420 in the examples shown in FIGS. 10 and 11 may include pivot links 422, connecting links 426, and a synchronizing shaft 430. It should be appreciated that the synchronizing system 420 may not include the pivot links 422 and instead may couple the connecting links 426 with the carriage 32 or the support 16. It also should be appreciated that the synchronizing system 420 may utilize a rack and pinion assembly as described below and illustrated in FIG. 12 to synchronize the rotation of the supports 16. It should further be appreciated that the synchronization system 420 may include a plurality of drive mechanisms 38 that are synchronized via electronic signals from a controller 86 as shown in FIG. 9. It should still further be appreciated that the connecting links 426 and the synchronizing gear 432 may both include coupling pin holes 428 therein with the coupling pins 424 extending therethrough to couple the connecting links 426 with synchronizing gear 432.

The pivot links 422 may include coupling pins 424 and may be coupled with the pivot mechanism 32 about the rotational axis R1. It should be appreciated that the pivot links 422 may be coupled with the supports 16. It should also be appreciated that the pivot links 422 may be coupled with the carriages 36. It should further be appreciated that the drive mechanism 38 may be coupled with the pivot links 422 to rotate the supports 16 and the upper frame assembly 12 about the rotational axis R1.

The connecting links 426 may extend longitudinally between the pivot links 422 and the synchronizing shaft 430. The connecting links 426 may couple with the pivot links 422 and the synchronizing shaft 430 by positioning the coupling pins 424 within the coupling pin holes 428. The connecting links 426 may move as the pivot links 422 rotate with the rotation of the supports 16 and the upper frame assembly 14. It should be appreciated that a drive mechanism 38 may be coupled with the connecting links 426 to rotate the carriages 36 about the rotational axis R1. It should also be appreciated that the connecting links 426 may be coupled with the supports 16 to rotate the supports 16 about the rotational axis R1. It should further be appreciated that the connecting links 426 may be coupled with the carriages 36 to rotate the carriage 36 about the rotational axis R1.

The coupling pin holes 428 may receive the coupling pins 424 to removably couple the connecting links 426 with the pivot links 422 and the synchronizing gears 432 mounted on the synchronizing shaft 430 as shown in FIGS. 10 and 11. It should be appreciated that the coupling pins 424 may be retained within the coupling pin holes 428. The coupling pin holes 428 may be generally located proximate the ends and/or the centers of the connecting links 426. It should be appreciated that the coupling pin holes 428 may be located anywhere along the connecting links 426 to engage the coupling pins 424 of the synchronizing gears 432.

The synchronizing shaft 230 may extend between the carriages 36 and may be rotatably mounted on the lower frame portion 15 with a plurality of synchronizing mounts 434. It should be appreciated that the synchronizing shaft 430 may be engaged by a drive mechanism 38 that rotates the synchronizing shaft 430 to synchronize the rotation of the supports 16 and the upper frame assembly 12. It should further be appreciated that at least a portion of the synchronizing mounts 434 may be composed of a bearing quality material, such as, nylon; or at least a portion of the synchronizing mount 434 engaging the synchronizing shaft 430 may be lubricated with a lubricant, such as, graphite, oil, silicone, or other lubricants.

Describing now the operation of these various illustrative embodiments, the motor 66 is activated and rotates the motor shaft 70. The rotation of the motor shaft 70 causes the motor gear 72 to rotate, which causes the drive gear assemblies 74, including the output gear 76, to rotate. The rotation of the output gear 76 causes the carriage gear 64 to rotate the carriage 36 about the pivot 34. As the carriage 36 rotates, the support 16 and the upper frame assembly 12 are rotated about the pivot 34. As the supports 16 and the upper frame assembly 12 rotate, the follower pins 28 move within the slots 78 of the rotational limit guides 40 and engage the plungers 84 of the limit detectors 42. The limit detectors 42 generate a rotational signal in response to the distance the plungers 84 are displaced across the limit switches 82. Also, as one of the supports 16 and the upper frame assembly 12 rotate, one of the pivot links 422 rotates about the rotational axis R1, which moves one of the connecting links 426 and rotates one of the synchronizing gears 432 and the synchronizing shaft 430. The rotation of the synchronizing shaft 430 causes another of the synchronizing gears 432 to rotate, which causes another of the connecting links 426 to move and rotate another of the pivot links 422 to synchronize rotation of the supports 16 and the upper frame assembly 12. The supports 16 and the upper frame assembly 12 are rotated until the motor 66 is stopped by a signal sent from the controller 86 indicating that the rotational magnitude of the supports 16 and the upper frame assembly 12 has reached a predetermined threshold of approximately 20°.

Figure 12:
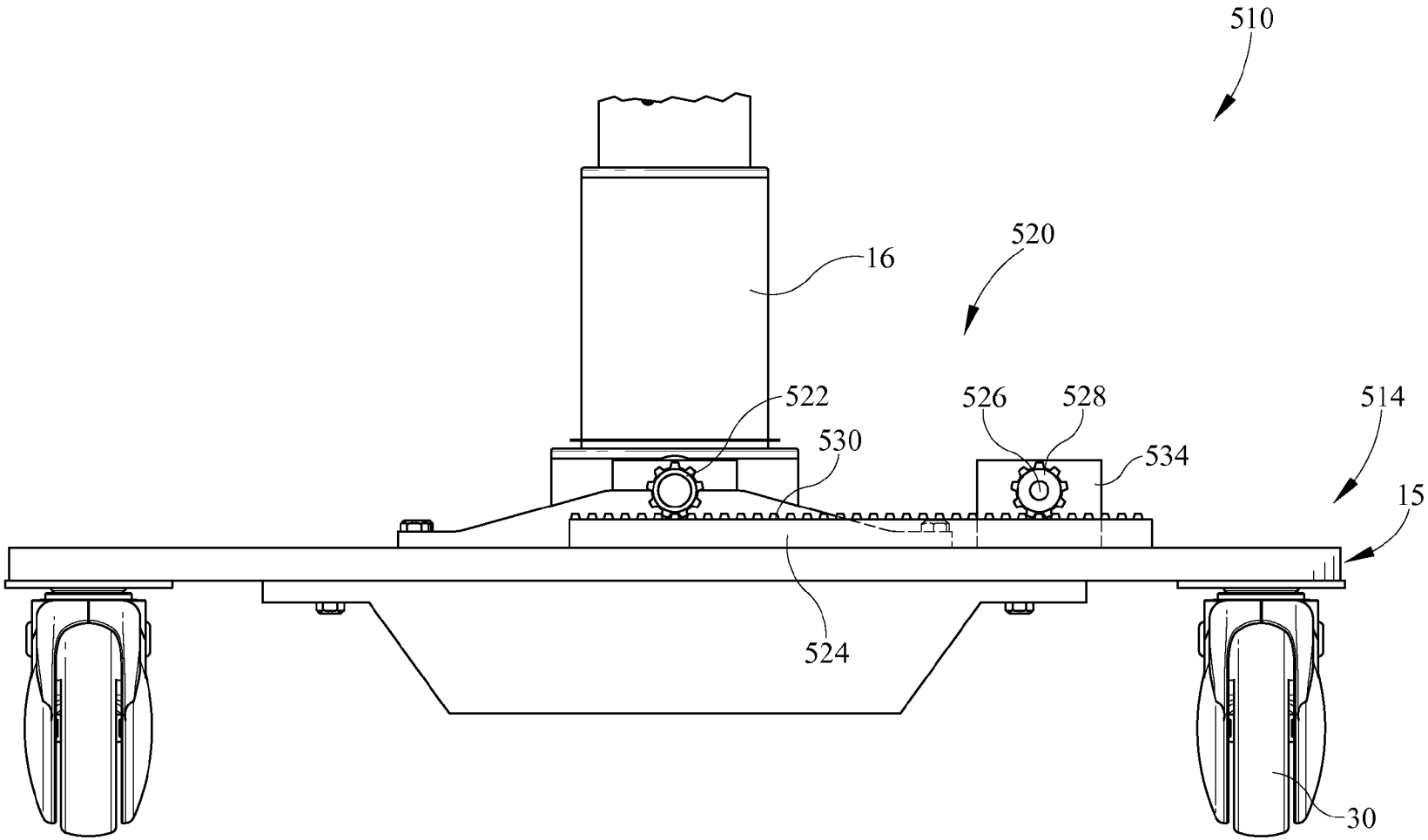
FIG. 12 is an end view of the synchronizing system according to another embodiment of the current disclosure.

A patient support apparatus 510 according to another embodiment of the current disclosure is shown in FIG. 12, wherein like numerals refer to like features previously described. The patient support apparatus 510 includes an upper frame assembly 12, lower frame assembly 514, and supports 16. The lower frame assembly 514 includes a pivot mechanism 32 and a synchronizing system 520. The synchronizing system 520 may be coupled with the carriages 36 to synchronize the rotation of the supports 16 so that the supports 16 rotate about the rotational axis R1 simultaneously. It should be appreciated that the synchronizing system 520 may couple with the supports 16 to synchronize the rotation of the supports 16 so that the supports 16 rotate about the rotational axis R1 simultaneously.

The synchronizing system 520 in the examples shown in FIG. 12 may include pivot gears 522, racks 524, and a synchronizing shaft 526 including synchronizing gears 528. It should be appreciated that the synchronizing system 520 may include multiple racks 524 on each lower frame portion 15. It should also be appreciated that the synchronizing system 520 may not include racks 524 and the synchronizing gears 528 may engage the pivot gears 522.

The pivot gears 522 may be coupled with the pivot mechanisms 32 about the rotational axis R1. It should be appreciated that the pivot gears 522 may be coupled with the supports 16. It should also be appreciated that the pivot gears 522 may be coupled with the carriages 36. It should further be appreciated that the drive mechanism 38 may engage the pivot gears 522 to rotate the supports 16 and the upper frame assembly 12 about the rotational axis R1.

The racks 524 may slidably engage the lower frame portions 15. It should be appreciated that the racks 524 may slidably engage or be retained within a channel (not shown) formed in the lower frame portion 15. At least a portion of the racks 524 may include a plurality of teeth 530 disposed over at least a portion of the racks 524. The teeth 530 may be engaged by the pivot gears 522 and the synchronizing gears 528.

The synchronizing shaft 526 may extend between the carriages 36 and may be rotatably mounted on the lower frame portion 15 with a plurality of synchronizing mounts 534 It should be appreciated that the synchronizing shaft 530 may be engaged by a drive mechanism 38 that rotates the synchronizing shaft 530 to synchronize the pivoting of the supports 16 and the upper frame assembly 12.

Describing now the operation of these various illustrative embodiments, the motor 66 is activated and rotates the motor shaft 70. The rotation of the motor shaft 70 causes the motor gear 72 to rotate, which causes the drive gear assemblies 74, including the output gear 76, to rotate. The rotation of the output gear 76 causes the carriage gear 64 to rotate the carriage 36 about the pivot 34. As the carriage 36 rotates, the support 16 and the upper frame assembly 12 are rotated about the pivot 34. As the supports 16 and the upper frame assembly 12 rotate, the follower pins 28 move within the slots 78 of the rotational limit guides 40 and engage the plungers 84 of the limit detectors 42. The limit detectors 42 generate a rotational signal in response to the distance the plungers 84 are displaced across the limit switches 82. Also, as one of the supports 16 and the upper frame assembly 12 rotate, one of the pivot gears 522 rotates about the rotational axis R1, which causes one of the racks 526 to move and rotate one of the synchronizing gears 528 and the synchronizing shaft 530. The rotation of the synchronizing shaft 530 causes another of the synchronizing gears 528 to rotate, which causes another of the racks 426 to move and rotate another of the pivot gears 522 coupled with another of the lower frame sections 514 to synchronize the pivoting of the supports 16 and the upper frame assembly 12. The supports 16 and the upper frame assembly 12 are rotated until the motor 66 is stopped by a signal sent from the controller 86 indicating that the rotational magnitude of the supports 16 and the upper frame assembly 12 has reached a predetermined threshold of approximately 20°.

Many other embodiments of the present disclosure are also envisioned. For example, a patient support apparatus comprises a lower frame, a lift mechanism, a drive mechanism, and an upper frame. The lower frame includes a lift drive configured to at least one of expand and contract the lift mechanism. The lift mechanism is pivotably coupled with the lower frame to rotate about a rotational axis. A drive mechanism is coupled between the lift mechanism and the lower frame. The drive mechanism is configured to rotate the lift mechanism about the rotational axis. The upper frame is supported on the lift mechanism and responsive to the rotation of the lift mechanism to rotate a patient about the rotational axis.

In another example, a patient support apparatus including a head end and a foot end defining a longitudinal axis extending therethrough, comprises a lower frame, an upper frame, a plurality of lift mechanisms. Each of the lift mechanisms are coupled with the upper frame and are pivotably coupled with the lower frame at a pivot. The pivots cooperate together to define a common rotational axis. The lift mechanisms rotate with the upper frame laterally about the rotational axis.

In yet another example, a patient support apparatus comprises a base, a deck, and a pivot mechanism. The deck is configured to support a patient. The deck includes a head section and a foot section that define a longitudinal axis extending therethrough. The pivot mechanism defines a rotational axis between the deck and the base. The deck is supported above the pivot mechanism and spaced apart therefrom by a support, the deck being configured to rotate laterally about the rotational axis.

Any theory, mechanism of operation, proof, or finding stated herein is meant to further enhance understanding of principles of the present disclosure and is not intended to make the present disclosure in any way dependent upon such theory, mechanism of operation, illustrative embodiment, proof, or finding. It should be understood that while the use of the word preferable, preferably or preferred in the description above indicates that the feature so described may be more desirable, it nonetheless may not be necessary and embodiments lacking the same may be contemplated as within the scope of the disclosure, that scope being defined by the claims that follow. In reading the claims it is intended that when words such as "a," "an," "at least one," "at least a portion" are used there is no intention to limit the claim to only one item unless specifically stated to the contrary in the claim. When the language "at least a portion" and/or "a portion" is used the item may include a portion and/or the entire item unless specifically stated to the contrary. While embodiments of the disclosure have been illustrated and described in detail in the drawings and foregoing description, the same are to be considered as illustrative and not restrictive in character, it being understood that only the selected embodiments have been shown and described and that all changes, modifications and equivalents that come within the spirit of the disclosure as defined herein or by any of the following claims are desired to be protected.

What is claimed is:

1. A patient support apparatus comprising a lower frame;

a lift mechanism including a lift drive configured to at least one of expand and contract the lift mechanism, the lift mechanism being pivotably coupled with the lower frame to rotate about a rotational axis;

a drive mechanism coupled between at least one of the first lift mechanism and the second lift mechanism and the lower frame, the drive mechanism configured to rotate the lift mechanism about the rotational axis; and an upper frame supported on the lift mechanism and responsive to the rotation of the lift mechanism to rotate a patient about the rotational axis, the upper frame including an upper frame base coupled to the lift mechanism and a deck movably supported on an upper frame base, the upper frame base having a first section configured to support a first section of the deck and a second section configured to support a second section of the deck, the first section of the upper frame base and the second section of the upper frame base being configured to remain substantially co-planar as the first portion of the deck moves with respect to the upper frame base.

2. The patient support apparatus of claim 1, wherein the lift drive causes the lift mechanism to at least one of raise and lower the upper frame with respect to the lower frame as the lift mechanism is rotated about the rotational axis.

3. The patient support apparatus of claim 1, wherein the upper frame defines an upper longitudinal axis extending longitudinally along the length of the upper frame about the lateral center of the upper frame, the rotational axis being parallel to the upper longitudinal axis.

4. The patient support apparatus of claim 1, wherein the drive mechanism is one of a motor coupled with a gear box, a linear actuator, a motor including a worm gear, and a motor with a threaded shaft having a nut rotatably engaging the threaded shaft.

5. The patient support apparatus of claim 1 further comprising a synchronizing system for synchronizing the rotation of the lift mechanism and a second lift mechanism.

6. A patient support apparatus including a first portion and a second portion with a longitudinal axis extending therethrough, comprising:

a lower frame;

an upper frame including a deck movably supported on an upper frame base, at least the first portion and the second portion of the upper frame base being configured to remain substantially co-planar as at least one of the first portion and the second portion of the deck moves with respect to the upper frame base; and a plurality of lift mechanisms each being coupled with the upper frame base and pivotably coupled with the lower frame at a pivot, the pivots cooperating together to define a common rotational axis, the upper frame rotating laterally with the lift mechanisms about the rotational axis.

7. The patient support apparatus of claim 6 further comprising a drive mechanism coupled between at least one of the lift mechanisms and the lower frame and configured to rotate the at least one of the lift mechanisms and the upper frame about the rotational axis.

8. The patient support apparatus of claim 6, wherein the longitudinal axis is parallel the rotational axis.

9. The patient support apparatus of claim 6, wherein the upper frame includes a deck with at least a body section and a main section, at least one of the body section and the main section being configured to rotate about a lateral axis that is perpendicular to the upper longitudinal axis to at least one of raise and lower at least one of the body section and the main section.

10. The patient support apparatus of claim 6, further comprising a synchronizing system for synchronizing the rotation of the lift mechanisms.

11. The patient support apparatus of claim 10, wherein the synchronizing system includes a controller electrically coupled with a drive mechanism, the drive mechanism coupled with the lower frame and pivotably coupled with one of the lift mechanisms, the controller synchronizing the movement of the drive mechanism to synchronize the movement of the lift mechanisms.

12. The patient support apparatus of claim 6, wherein the lower frame includes a rotational limit guide and at least one of the lift mechanisms includes a protrusion movable within the rotational limit guide as the lift mechanisms are rotated about the rotational axis.

13. The patient support apparatus of claim 6, wherein the lower frame includes a plurality of limit detectors for sensing a position of the lift mechanisms as the lift mechanisms are rotated about the rotational axis.

14. The patient support apparatus of claim 13 further comprising a controller configured to receive a signal from the limit detectors and configured to prevent the lift mechanisms from rotating beyond a predetermined rotational magnitude threshold.

15. The patient support apparatus of claim 14, wherein the predetermined rotational magnitude threshold is about 20° with respect to a vertical axis defined by the lift mechanisms when the lift mechanisms are positioned perpendicular to the lower frame.

16. The patient support apparatus of claim 10, wherein the synchronizing system is at least one of a linkage system and a rack and pinion system.

17. The patient support apparatus of claim 7, wherein the drive mechanism is a drive mechanism selected from the group of drive mechanisms including a manual crank, a lever, a multi-positional lock, and a pedal arrangement.

18. A patient support apparatus, comprising:

a lower frame;

an upper frame having a first portion and a second portion with a longitudinal axis extending therethrough, the upper frame including a deck movably supported on an upper frame base, the first portion of the upper frame base and the second portion of the upper frame base being configured to remain substantially co-planar as the first portion of the deck moves with respect to the upper frame base; and a pivot mechanism defining a rotational axis between the upper frame and the lower frame, the upper frame being supported above the pivot mechanism and spaced apart therefrom by a support, the upper frame being configured to rotate laterally about the rotational axis.

19. The patient support apparatus claim 18, wherein the upper frame and the support define concentric arcs as the support and the upper frame are rotated about the rotational axis.

20. The patient support apparatus of claim 18, wherein the pivot mechanism includes a pivot along the rotational axis and a carriage pivotably coupled with the pivot, the carriage supporting the support and rotating with the support about the rotational axis.

* * * * *